US012337381B2

(12) United States Patent
Fischer et al.

(10) Patent No.: US 12,337,381 B2
(45) Date of Patent: Jun. 24, 2025

(54) RISER

(71) Applicant: ASK Chemicals GmbH, Hilden (DE)

(72) Inventors: Stefan Fischer, Mandelbachtal (DE); Marcus Friederici, Zwickau (DE); Imanol Ortiz, Bilboa (ES); Udo Skerdi, Vallendar (DE); Ulrich Voigt, Leipzig (DE)

(73) Assignee: ASK Chemicals GmbH, Hilden (DE)

( * ) Notice: Subject to any disclaimer, the term of this patent is extended or adjusted under 35 U.S.C. 154(b) by 0 days.

(21) Appl. No.: 18/709,300

(22) PCT Filed: Oct. 12, 2022

(86) PCT No.: PCT/DE2022/100757
§ 371 (c)(1),
(2) Date: May 10, 2024

(87) PCT Pub. No.: WO2023/083404
PCT Pub. Date: May 19, 2023

(65) Prior Publication Data

US 2024/0416414 A1 Dec. 19, 2024

(30) Foreign Application Priority Data

Nov. 10, 2021 (DE) ..... 20 2021 106 147.2

(51) Int. Cl.
*B22C 9/08* (2006.01)
*B22D 35/04* (2006.01)

(52) U.S. Cl.
CPC ..... *B22D 35/04* (2013.01); *B22C 9/088* (2013.01)

(58) Field of Classification Search
CPC ..... B22C 9/08; B22C 9/084; B22C 9/088
See application file for complete search history.

(56) References Cited

U.S. PATENT DOCUMENTS 12,151,281 B2 * 11/2024 Pfannenstiel ..... B22C 9/088

FOREIGN PATENT DOCUMENTS

| | | | | |
|---|---|---|---|---|
| DE | 102005008324 A1 | 8/2006 | | |
| DE | 202004021109 U1 | 10/2006 | | |
| DE | 202016103215 U1 | 7/2017 | | |
| EP | 1775045 A2 * | 4/2007 | ..... | B22C 9/088 |

* cited by examiner

*Primary Examiner* — Kevin E Yoon
(74) *Attorney, Agent, or Firm* — Standley Law Group LLP; Jeffrey S. Standley; Kenny W. Pung

(57) ABSTRACT

The invention relates to a molding riser for casting metals, wherein the riser has a metal riser body. The invention also relates to the use of the riser for casting metals into separable casting molds, in particular horizontally separable casting molds.

14 Claims, 4 Drawing Sheets

RISER

The present invention relates to a riser for metal casting, with the riser having a metal riser body. Furthermore, the present invention relates to the use of the riser for metal casting using separable casting molds, in particular with horizontally separable casting molds.

PRIOR ART

Risers are generally known from prior art. Usually, moldable risers, i.e. risers that are attachable to a mold plate, are made of exothermic materials or insulating materials. For example, the type of riser material used (exothermic or insulating) depends on the casting piece to be produced or the type of metal casting.

A riser is arranged above the portion of the casting piece to be fed on so that due to the metallostatic pressure, the liquid metal can be post-fed to the casting piece. Usually, a casting mold is filled with liquid metal from the outside, for example via a suitable gating system, wherein the liquid metal runs through the casting mold into the riser. With risers arranged above the casting piece, the liquid metal only reaches the riser cavity when the casting mold or the portion of the casting to be fed on is almost completely filled up with liquid metal.

Exothermic riser materials are characterized, among other things, by the fact that an exothermic reaction takes place when the riser is filled with liquid metal, thereby heating the metal inside the riser during a specified period of time, thus remaining liquid while being supplied to the casting piece being cooled. Volume contraction of the casting piece during solidification can be compensated for by the liquid metal in the riser. Insulating riser materials slow down heat dissipation from the riser or from the liquid metal in the riser into the mold material, keeping the liquid metal liquid or flowable over a longer period of time. As a result, liquid metal is kept available to compensate for volume contraction of the casting. This is also known as post-feeding.

Natural risers are risers that are made from the same molding material as the entire casting mold and are produced or formed without the use of insulating or exothermic materials. In the simplest case, a natural riser is, for example, a recess in the molding material into which liquid metal can flow in or out. Natural risers can also be covered with exothermic covering powder to maintain their feeding capacity for a long time.

By definition, natural risers are neither made from insulating nor exothermic materials. This has the advantage that natural risers produce fewer emissions during metal casting than conventional risers made from exothermic or insulating materials. Another advantage of natural risers over conventional risers is that they leave less residue in the mold material after metal casting, for example in the form of pyrolysis products, than conventional risers made from exothermic or insulating materials.

Natural risers are usually formed in the mold material as a mold cavity using a riser model, which is firmly arranged on the mold plate (model plate). In the simplest case, the riser model matches the mold cavity. The molded material surrounds the riser model and the mold plate forming the casting mold (cast mold) following compaction and subsequent molding of the mold plate from the compacted molded material.

This means that the riser models known from the prior art are connected to the mold plate and the riser models are removed again from the compacted mold material when molding the natural riser. This has the disadvantage that natural risers can only be placed laterally next to the casting geometry on the mold plate (model plate) without undercuts, i.e. in the direction of the surface normal to the plane of the mold plate, as otherwise undercuts occur during molding, i.e. when the mold plate is removed together with the riser model from the compressed molding material, rendering the mold unusable. Moldable natural risers that allow placement above the casting are not yet known.

Moldable risers made of exothermic or insulating material are usually placed on a riser pin attached to a mold plate, i.e. they are not firmly attached to the mold plate. The molded material around the formable riser is then compacted. After compaction, the mold plate, which corresponds to the casting, is pulled out of the compacted molding material together with the riser pin, leaving the moldable riser in the molded material.

The production of castings occurs, among other things, in separable casting molds, wherein the casting molds are either vertically separable or horizontally separable. Vertically separable casting molds are described, for example, in EP 2982458 A1. Vertically separable casting molds are for example employed in molding systems of DISAMATIC Company (Denmark).

DE 202006009015 U1 discloses a one-piece, metal riser, wherein the riser body is double-walled with an inner wall and an outer wall. The cavity between the inner and outer walls is used for insulation. However, the riser cavity is not formed by two riser body parts.

The disadvantage of moldable risers according to prior art is that production of such risers from exothermic or insulating materials is costly due to expensive feedstocks and the time required for production. In addition, when exothermic and insulating materials are used, pyrolysis products thereof and components such as fluorine carriers, unburned aluminum or fibers are introduced into the molded material. This may reduce reusability of used casting sands resulting in additional costs for disposal of used casting sands (used sands). Emissions are also released during riser incineration, which significantly contribute to the overall emission load of a foundry. However, this is undesirable. In addition, it is a known problem that industrially produced risers are usually delivered to the customer ready for use, i.e. in a fully assembled state, although shipping of the risers is usually inefficient due to the empty volumes of the manufactured risers resulting in high shipping costs.

Therefore, there is still a need for risers that can be produced more cost-effectively than the risers known from prior art. It would also be desirable if such risers, when properly used, would neither contaminate the molding material nor increase the foundry emission load. Furthermore, it would be desirable if such risers could be stored and shipped in a more cost-efficient and space-saving manner, i.e. if the risers could be packed in a more space-saving manner, for example.

OBJECT OF THE INVENTION

It is thus an object of the present invention to provide a riser which can be produced at a reasonable cost and combining the advantages of a natural riser in terms of reduced emission load and impurities during metal casting with the geometric freedom of a moldable riser. Furthermore, it would be desirable to provide a riser the transportation of which is more cost-effective because, among other things, it requires less space.

DESCRIPTION OF THE INVENTION

According to the invention, this object and further objects will be achieved by the subject matter of the independent patent claims. Preferred embodiments are the contents of the subclaims or will be described herein in more detail below.

Surprisingly, it was found that risers which have a metal riser body can be produced in a cost-effective manner without achieving casting results of poorer quality, for example with regard to any defects found on the casting (so-called shrinkage). Furthermore, it was surprising that the riser bodies of the risers according to the invention, which are preferably made of a metal sheet such as aluminum or steel sheet, can withstand the usual compaction pressures of high-pressure molding systems without the risers collapsing when the molding material is compressed.

The present invention relates to a riser for metal casting, which comprises a riser body made of metal. The riser body has a riser cavity for receiving liquid metal and additionally has at least one opening through which the liquid metal can flow into the riser cavity or out of the riser cavity.

Furthermore, the present invention relates to the use of a riser according to the invention in metal casting in separable casting molds, in particular in horizontally separable casting molds.

DETAILED DESCRIPTION OF THE INVENTION

Surprisingly, the inventors have found that risers having a metal riser body can be produced and used with ease and at reasonable cost as compared to conventional insulating or exothermic risers. Furthermore, it was unexpected that the risers can withstand compression pressures, as required for molding materials to be compressed, without collapsing.

According to the invention, the risers have a metal riser body. This means that the riser body of the riser according to the invention is not made of insulating or exothermic riser materials.

The metal riser body of a riser according to the invention has a thickness of 0.1 to 1.5 mm. In particular, the metal sheet of the riser body preferably has a thickness of 0.1 mm to 1.2 mm, more preferably 0.2 mm to 1.0 mm and more preferably 0.3 mm to 0.7 mm. Surprisingly, the inventors have found that metal sheets which have a thickness of at least 0.1 mm do not collapse the riser bodies when the molding material is compressed at conventional compression pressures, which in some cases can be more than 100 bar.

The riser body is made of one or more metals. In particular, the riser body of the riser according to the invention is produced from a metal sheet by forming, wherein the metal sheet is preferably produced on a similar basis of material as the casting material used. Thus, a riser according to the invention, which has a riser body made of an aluminum sheet, is preferably used for an aluminum casting, whereas a riser body made of a steel sheet or an iron sheet is preferably used for a steel casting or an iron casting. It is also possible for the riser body to be made of different metals. The sheet metals preferably used are such that they can be deep-drawn or otherwise cold-formed. In one embodiment, the riser body is made from cold-rolled strip DIN 10130 DC01 or DC04, which is known to persons skilled in the art.

The riser body of the riser according to the invention has a riser cavity and at least one opening. The riser cavity is designed to receive liquid metal during the casting process. During the casting process or when the casting cools, liquid metal can be post-fed to the riser body via the opening or be fed to the casting to be cooled.

The riser body of the riser according to the invention can have different shapes. In particular, it is possible for the riser body to have the shape of a so-called spherical riser. This may be preferred, as spheres have the smallest surface area of all possible bodies for a given volume. The advantage of such a shape is that the heat exchange with the environment during the casting process is kept to a minimum, which means that the liquid metal in the riser is kept liquid or flowable for as long as possible during proper use.

The riser body of a riser according to the invention is formed in multiple parts. In one embodiment, the riser body of a riser according to the invention is formed in two parts and has two riser body parts which are assembled together, the two riser body parts preferably being of approximately the same size.

In another embodiment, the riser body of a riser according to the invention can have a shape which tapers at least partially towards the mold plate.

Tapering of the riser body may be preferred to create a suitable breaking edge between the riser body and the mold plate or, after molding, between the riser body and the casting after compaction, which obviates the need for post-processing the casting or at least simplifies post-processing and reduces post-processing time.

Preferably, the riser according to the invention has a connecting element that is in contact with the riser body via the opening in the riser body. The riser body is directly or indirectly connected to the casting or to the casting mold via the connecting element. The connecting element tapers towards the casting thereby helping to form a breaking edge. Connecting elements are known, for example, from DE 202012102418 U1, DE 10142357 A1, EP 1184104 A1 and DE 102005008324 A1. The connecting element is designed to create a breaking edge between the riser body and the mold plate or, after molding, between the riser body and the casting after compaction, which makes post-processing of the casting unnecessary or at least simplifies post-processing and reduces the time required for post-processing.

In one embodiment, the connecting element is a tube-like body, which can have any length, wall thickness and diameter that is suitable in each individual case. Depending on the material used, the wall thickness will generally be between 0.1 mm and 10 mm, preferably between 0.3 mm and 5 mm, particularly preferably 0.3 mm to 0.5 mm. The person skilled in the art may be able to determine the optimum dimensions based on his experience. As a rule, the tube-like body has a length of between about 15 and about 300 mm, in particular between about 35 and about 100 mm. In a preferred embodiment according to the invention, the length of the tube-like body is selected such that at least the distance between the riser body and the casting will be bridged.

Basically, the inner diameter of the tube-like body can arbitrarily be selected, the opening at the lower or upper end of the tube-like body being large enough to ensure the flow of the melt into or out of the riser during the casting and solidification procedure. The diameter of the tube-like body is generally based on the diameter of the opening provided in the riser body through which the tube-like body is passed and in which it is displaceable. As a rule, the diameter of the tube-like body is selected such that the opening in the riser body ensures sufficient guidance of the tube-like body when pushing it into the riser body during compression of the molding material or pulling it out of the riser body before attaching it to the mold plate.

The tube-like body itself can be formed from any suitable material showing appropriate strength without any interference with the casting piece to be supplied. These materials are known to persons skilled in the art and include, for example, metal, plastic, cardboard, ceramic or similar materials. Preferably, the tube-like body is made of a material that is equivalent to a material used in the casting routine, such as aluminum or steel sheet metal or iron sheet metal. Particularly preferably, the connecting element or the tube-like body is made of the same material as the riser body.

In one embodiment, the tubular body has a stop in the portion facing the riser cavity. The stop is therefore arranged in a position on the tubular body such that it is located within the riser cavity provided in the riser body. When the tubular body is pulled out of the riser body, the stop comes to rest against a surface which adjoins the opening in the cavity. Basically, the stop can be of any design as long as it is ensured that the tubular body cannot fall out of the opening. For example, the stop can be designed as a thickening on the outside of the tubular body and run around the tubular body along its circumference. However, individual projections may also be provided, with the number of projections preferably being sufficiently high to prevent the tubular riser from tilting when it is fully pulled out. It is also possible to design the stop as a separate component and subsequently attach it to the tubular body. The stop is preferably designed as an annular projection that runs around the outer circumference of the tubular body. This ensures the tubular body to be centered when it is pulled out of the riser body so that the longitudinal axis of the tubular body runs parallel to the longitudinal axis of the riser body.

In another embodiment, the connecting element is a tube-like body and has a thickening at a lower portion, which is designed to prevent the connecting element from slipping into the riser cavity of the riser body when compressing the molding material. For the purposes of the present invention, the lower end of the connecting element means the end facing the casting or the end facing the mold plate.

In another embodiment, the connecting element has a stop or a thickening at the upper end and a thickening or a stop at another lower end. This can be particularly preferable to prevent the connecting element from completely slipping into the riser cavity and also to prevent the connecting element from falling out of the riser body.

In another embodiment, the connecting element is designed to be retractable, equivalent to an accordion, as disclosed, for example, in DE 202012102418 U1. In this case, the connecting element is attached to or on the riser body such that the connecting element retractably moves in relation to the riser body of the riser according to the invention when compressing the molded material. In this embodiment, the connecting element is preferably made of plastics or metal, in particular a sheet metal, and is attached directly to the riser body. In this case, the connecting element and riser body can be integrally formed.

In a preferred embodiment, the riser body has a recess adjacent to the opening to accommodate the upper end of a centering pin and/or a spring pin. The recess is arranged opposite the opening of the riser body to allow a centering pin or a spring pin to be inserted through the opening in the riser body (and, if present, previously guided through the connecting element) and into the recess to center the riser on the mold plate. The centering pin or spring pin is used to position the riser according to the invention on the mold plate (model plate). The spring pin or the centering pin is pulled out of the final casting mold or part of the final casting mold together with the mold plate after compacting the molding material.

In a preferred embodiment, the riser body has a recess for a lid. In this embodiment, the lid also preferably has the recess described above, into which a centering pin and/or a spring pin can be inserted. The riser according to the invention is arranged on a mold plate or the riser according to the invention is placed on the mold plate using a centering pin or a spring pin. The centering pin or spring pin is guided through the opening in the riser body or through an optional connecting element arranged in the riser body through the riser cavity to the opening in the lid. In this embodiment, the lid arranged in the riser body is arranged opposite the opening of the riser body through which liquid metal enters the riser cavity or through which liquid metal can be fed to the cooling casting. In a preferred embodiment, the lid can form a William core. The lid has the shape of a conical, tapered core. The William core is inserted into the riser and serves to form a sand edge which is for delaying solidification of the liquid metal due to the sand edge effect. The lid can be made of different materials, but in particular it is made of the same materials as the riser body or the optional connecting element.

The riser body of the riser according to the invention is of a multiple part design, in particular a two-part or three-part design, particularly preferably a two-part design. This riser has at least a first and a second riser body part. Conventional risers known from prior art have one-piece riser bodies. One of the disadvantages thereof is that the risers occupy a large empty volume during shipping due to the riser cavity, making transport economically inefficient. Surprisingly, the inventors have found that risers with multiple part riser bodies, in particular two-part or three-part riser bodies, are easy to transport and can be assembled or plugged together easily by the end user or customer. It was particularly surprising that even risers with multiple part riser bodies can withstand the high compression pressures without collapsing.

In one embodiment, the riser body is formed in two parts, having a first and a second riser body part. In another embodiment, the riser body is formed in three parts having a first, a second and a third riser body part. Preferably, the riser body of a riser according to the invention is formed in two parts having a first riser body part and a second riser body part. In another preferred embodiment, the multiple part riser body part is separable horizontally into two riser body parts, for example of approximately equal size. In another preferred embodiment, the multiple part riser body part is separable vertically into two riser body parts, e.g. of approximately equal size. In a further preferred embodiment, the two riser body parts have a half-shell shape. This expressly also includes embodiments in which, for example, the riser body is horizontally separable and the first riser body part optionally has an opening, for example for a centering or riser pin or a lid, and the second riser body part has an opening through which liquid metal can flow into or out of the riser cavity. For the purposes of the present invention, half-shell shape expressly means not only those riser body parts which have an identical shape, but also those riser body parts which are of different shapes. The riser body parts are joined together essentially horizontally or essentially vertically and form the riser cavity for receiving the liquid metal. In particular, the riser body parts are joined together such that both riser body parts additively form the riser cavity. In particular, the riser body parts are preferably designed almost identically. This has the advantage that they can be produced using a single tool.

In a preferred embodiment, the riser body parts of a multiple part riser body of a riser according to the invention have connecting means used to connect or assemble and/or join the riser body parts to form the riser body. In the context of the present invention, assemblable or joinable means that the riser body parts have connecting means which are used to plug them together and/or assemble them. Thus, in a preferred embodiment of the present invention, a multiple part riser can be assembled or joined using a click fastener. According to another embodiment, the first and second riser body parts can be plugged together and/or assembled by means of a bayonet catch. According to another embodiment, the riser body parts have one or more plug connections with which the riser body parts can be plugged together. According to another embodiment, the riser body parts have tongue and groove so that these respective riser body parts can be joined to form a riser body. According to another embodiment, one of the riser body parts has clamping elements with which the riser body part can be clamped to another riser body part. According to another embodiment, the riser body parts each have a crimped edge, wherein the riser body parts can be placed against each other in such a way that the crimped edges can be placed against each other and connected to each other by crimping or riveting.

In another embodiment, the multiple part riser bodies can be welded together. In another embodiment, it is possible for the riser body parts of a riser according to the invention to be screwed together. It is also possible for the riser body parts to be glued together. In another embodiment, the riser body parts are joined together by a rivet.

In another preferred embodiment, it is possible that at least one riser body part of a multiple part riser, preferably a horizontally separable multiple part riser, is designed such that it tapers towards the model plate, equivalent to the shape of a connecting element. Tapering of the riser body may be preferred to create a suitable breaking edge between the riser body and the model plate or, after molding, between the riser body and the casting piece after compaction, which obviates the need for post-processing of the casting or at least simplifies post-processing and reduces the post-processing time or at least the simple cutting off of the riser neck. Another preferred design of a riser body part is such that it deforms like an accordion when being compressed with the molding material and can thus be retracted. In particular, the accordion-like portion assumes the function of the connecting element, but in this case will preferably be an integral component of a riser body part. In particular, the accordion-like portion tapers to form a grommet, which is for connecting it to the casting.

The present invention is further illustrated while reference is made to the following figures, wherein.

Figure 1:
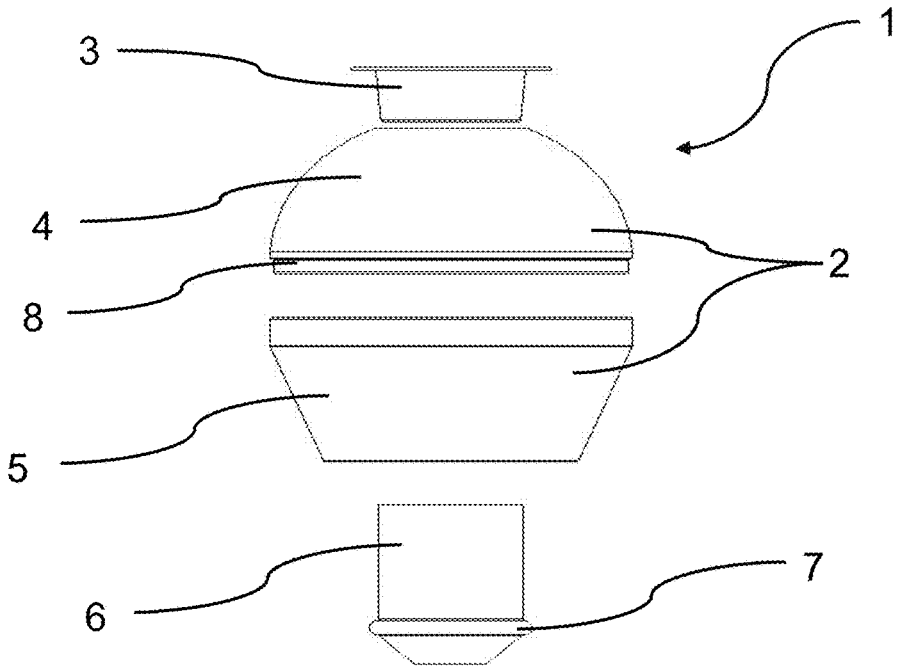
FIG. 1 shows an exploded view of a riser according to the invention with a two-part, horizontally divided riser body part comprising a first and a second riser body part and a lid and a connecting element.

FIG. 1 shows an exploded view of a riser 1 according to the invention with a two-part riser body 2. The riser according to the invention has the configuration of a spherical riser. The two-part riser body 2 has a first riser body part 4 and a second riser body part 5. A recess for a lid 3 is arranged in the first riser body part 4, in which a recess for a centering pin is arranged (not shown). The second riser body part 5 has an opening that slidably receives the connecting element 6 and tapers in the direction of the mold plate (not shown). The riser body 2 is separable horizontally into approximately two riser body parts of equal size by the first riser body part 4 and the second riser body part 5. A connecting means 8 is arranged on the first riser body part 4 in the form of a track running around the first riser body part 4 with clamping elements (not shown), used to clamp or insert the first riser body part 4 into the second riser body part 5. The clamping elements form a connecting means 8, through which the first riser body part 4 and the second riser body part 5 can be connected to each other and brought into engagement. A thickening 7 is arranged at the lower end of the connecting element 6, which is suitable for preventing the connecting element 6 from being pushed into the riser cavity 9 (not shown) of the riser 1 according to the invention when the molding material is compressed.

Figure 2:
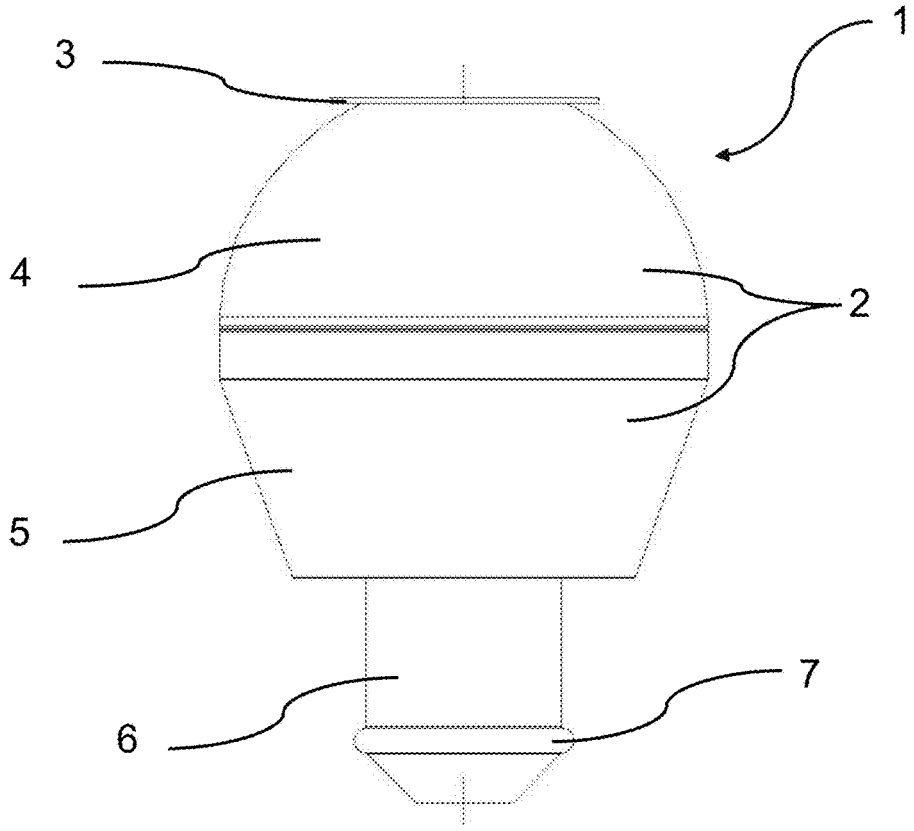
FIG. 2 shows a side view of the riser according to FIG. 1, wherein the first riser body part, the second riser body part, the lid and the connecting element are in an assembled state.

FIG. 2 shows a side view of the assembled riser 1 of FIG. 1. The lid 3 is inserted into the recess of the first riser body part 4. The lid 3 has a recess for a centering pin or for a spring pin (not shown). The first riser body part 4 and the second riser body part 5 together form the riser body 2. The riser body is assembled using the connecting means 8 (not shown) or the connecting means 8 engages into the upper edge of the second riser body part 5. The second riser body part 5 tapers in the direction of the mold plate (not shown). The connecting element 6 is slidably arranged in the opening of the second riser body part 5. The connecting element 6 is designed to connect the riser body 2 to the mold plate or the casting (not shown). The connecting element 6 contributes to the formation of a suitable breaking edge. The connecting element 6 can slide or slip into the riser cavity 9 (not shown) in the riser body 2 when compressing the molding material. The thickening 7, which is arranged at the lower end of the connecting element 6, prevents the connecting element 6 from completely sliding into the riser cavity 9 (not shown) of the riser body 2, for example when compressing the molded material.

Figure 3:
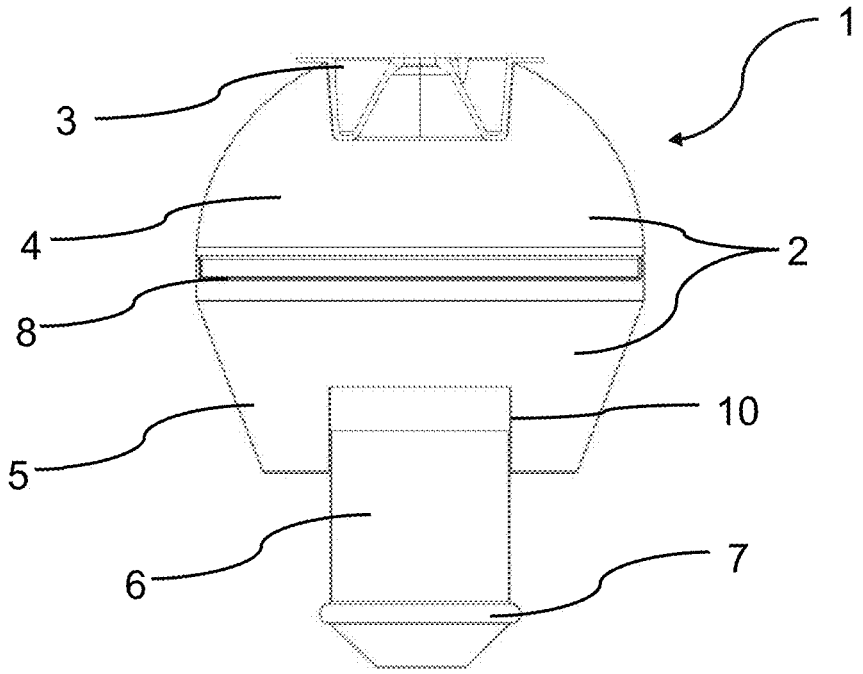
FIG. 3 shows a sectional view of a riser according to the invention as shown in FIG. 1 and FIG. 2.

FIG. 3 shows a section across the riser according to FIG. 2. In the lid 3, which is arranged in a recess of the first riser body part 4, a recess for a centering pin or for a spring pin is to be seen. The connecting means 8, which is arranged on a circumferential path in the form of clamping elements on the first riser body part 4 (see FIG. 2), connects the first riser body part 4 to the second riser body part 5, such that these two riser body parts, which are approximately the same size and horizontally divided, form the riser body 2. The connecting element 6, which is arranged in a recess in the second riser body part 5, can slide into the riser cavity 9 when the molding material is compressed along the guide of the connecting element 10, thus forming a breaking edge between the finished casting and a riser residue. The thickening on the connecting element 7 prevents the connecting element 6 from completely falling into the riser cavity 9 when compressing the molding material.

Figure 4:
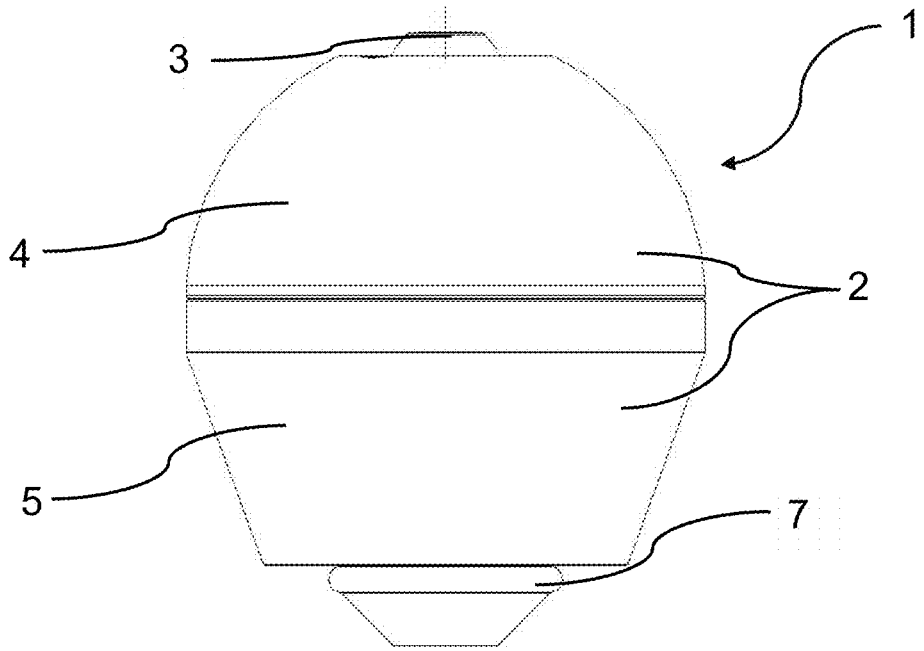
FIG. 4 shows a side view of the assembled riser according to FIG. 2 after compression of the molding material, with the connecting element inserted into the riser cavity.

FIG. 4 shows a top view of an assembled riser 1 according to FIG. 2 and FIG. 3, but following compression of the molding material. Herein, the thickening of the connecting element 6 contacts the second riser body part 5 and prevents the connecting element 6 from completely sliding into the riser cavity 9 of the riser according to the invention, which is formed by the riser body 2.

Figure 5:
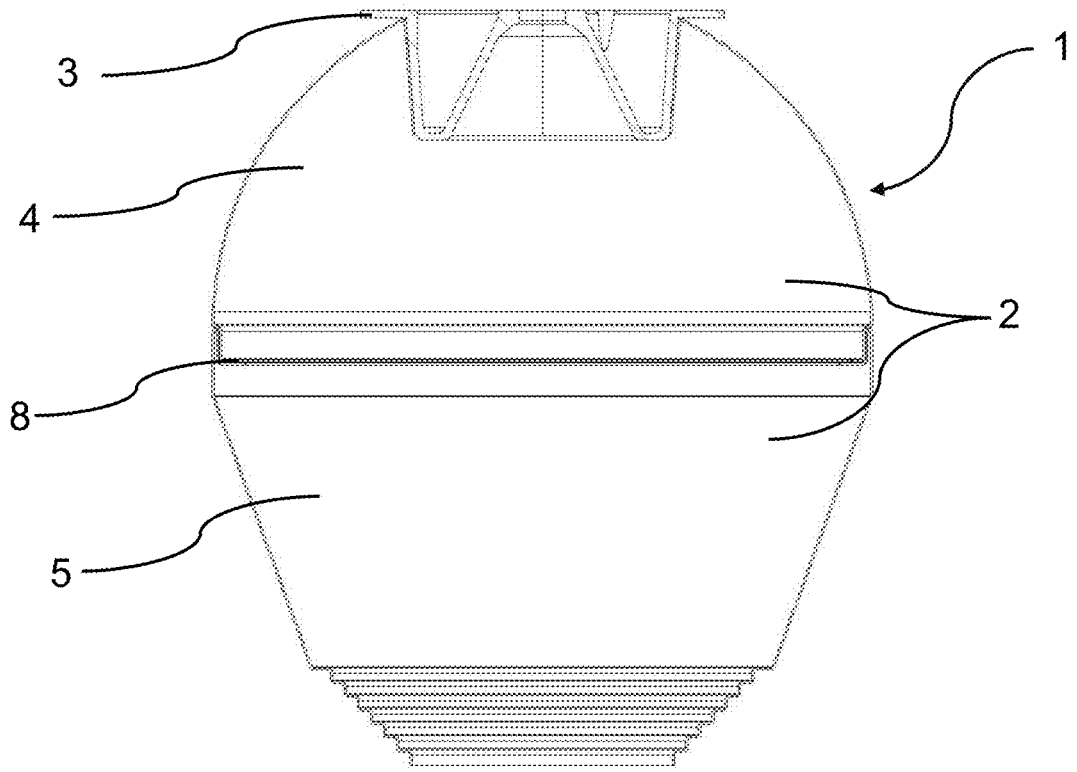
FIG. 5 shows a sectional view of a riser with a two-part riser body, the second riser body part tapering downwards and being accordion-stepped there.
Figure 6:
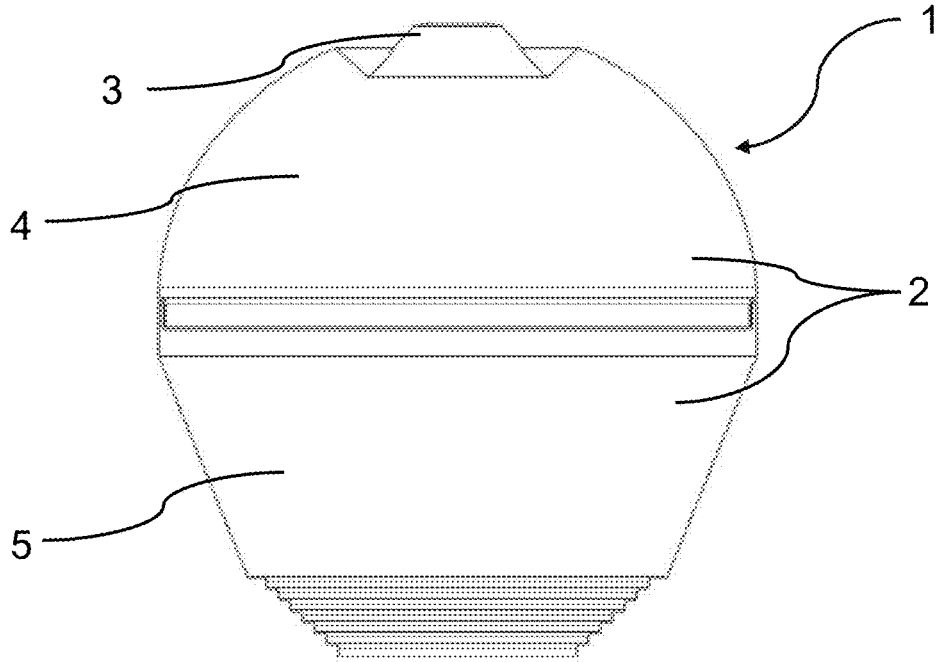
FIG. 6 shows a side view of the riser according to FIG. 5.

FIG. 5 and FIG. 6 show a sectional view (FIG. 5) and a side view (FIG. 6) across and onto a riser according to the invention according to another embodiment, respectively. In the lid 3, which is arranged in a recess of the first riser body part 4, an recess for a centering pin or for a spring pin can be seen (FIG. 5). The connecting means 8, which is arranged on a circumferential path in the form of clamping elements on the first riser body part 4 (equivalent to FIGS. 1 to 4; not shown), connects the first riser body part 4 to the second riser body part 5, such that these two riser body parts 4, 5, which are approximately the same size and horizontally divided, form the riser body 2. The first and second riser body parts 4, 5 have a half-shell shape. Both riser body parts 4, 5 have different designs. The first riser body part 4 has an opening for the lid 3. The opening through which liquid metal can flow into the riser cavity (not shown) or out of the riser cavity (not shown) is arranged in the second riser body part. The second riser body part 5 tapers in a stepped manner in the direction of the mold plate (not shown) and is designed in such that it can be retracted like an accordion when compressing the molding material (not shown) thereby forming a breaking edge between the final casting and the riser 1 according to the invention.

Figure 7:
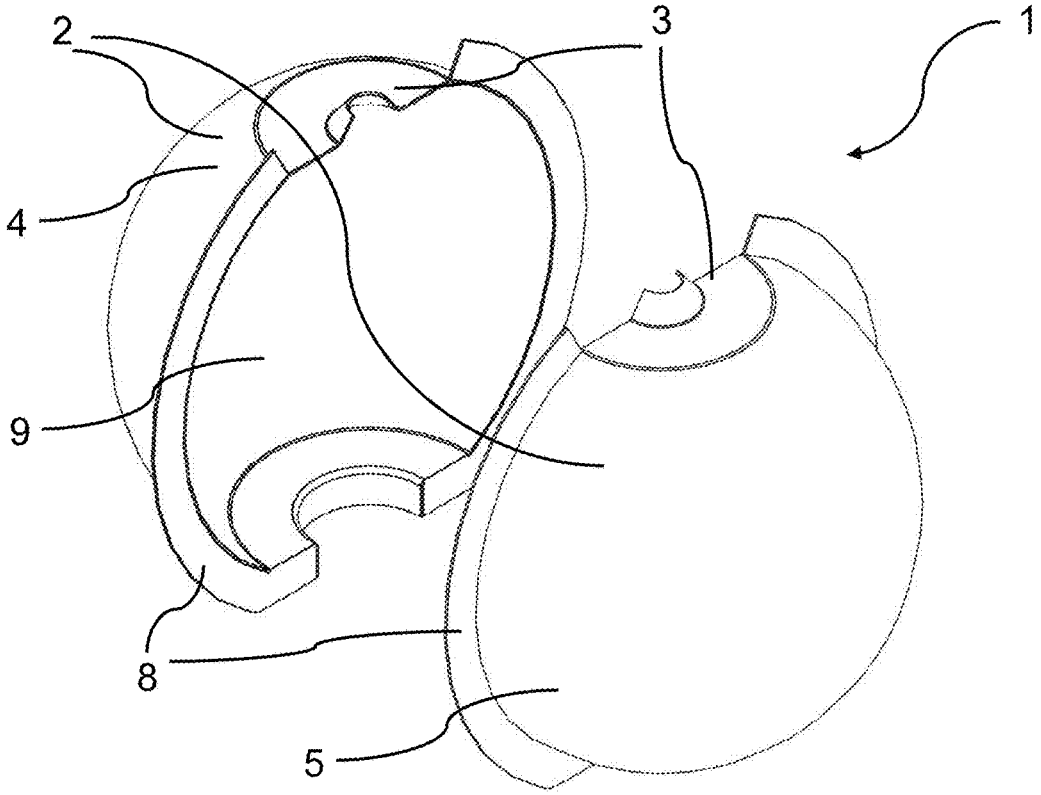
FIG. 7 shows an exploded view of a riser according to the invention with a two-part, vertically divided riser body part comprising a first and a second riser body part.
Figure 8:
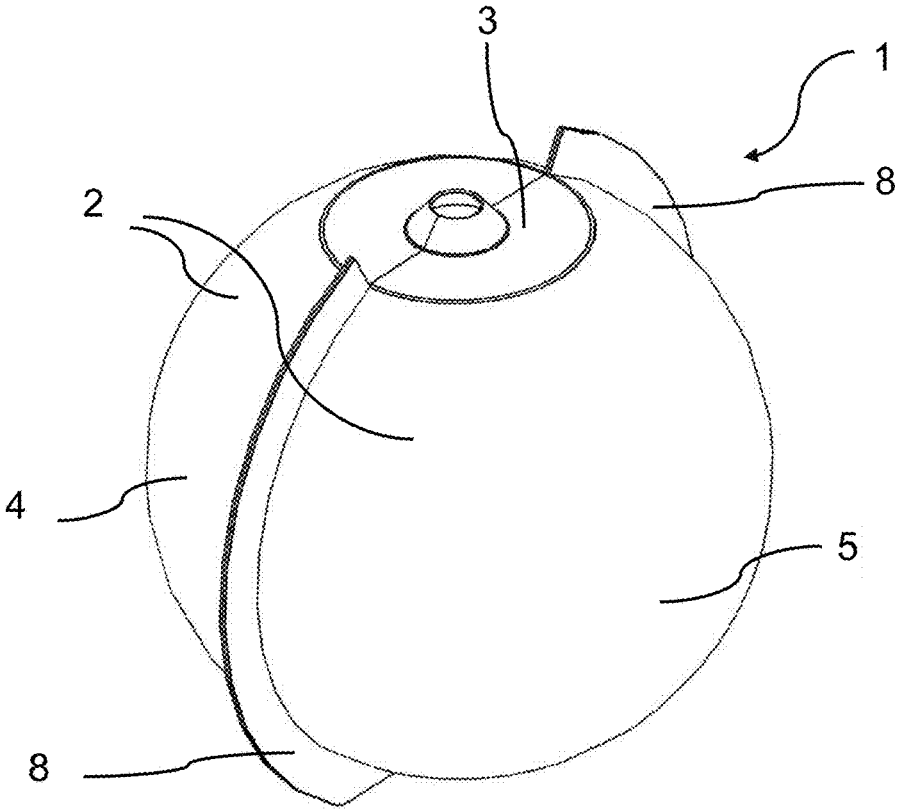
FIG. 8 shows a perspective side view of the riser according to FIG. 7.

FIG. 7 and FIG. 8 show an exploded view (FIG. 7) and a perspective side view (FIG. 8) of another riser body 1. This one has a first riser body part 4 and a second riser body part 5, which have approximately the same dimensions and are divided in a vertical direction. Both riser body parts 4, 5 have identical half-shell shapes. Both the first riser body part 4 and the second riser body part 5 each have a recess for a centering pin or for a spring pin at the upper end (i. e. the end facing away from the casting). Both the first and the second riser body part 4, 5 have connecting means 8 in the form of a crimped edge at least partially surrounding the two riser body parts 4, 5. The two riser body parts 4, 5 can be glued together using the connecting means 8. Furthermore, both riser body parts 4, 5 have an opening for a connecting element 6 (not shown), which is arranged opposite the recess for the centering pin. Inside the two riser body parts 4, 5, the riser cavity 9 is provided, which is used to accommodate liquid metal.

| List of reference numbers: | |
|---|---|
| 1. | Riser |
| 2. | Riser body |
| 3. | Lid |
| 4. | First riser body part |
| 5. | Second riser body part |
| 6. | Connecting element |
| 7. | Thickening at connecting element |
| 8. | Connecting means |
| 9. | Riser cavity |
| 10. | Guide connecting element |

The invention claimed is:

1. A riser for metal casting, comprising:

a riser body, wherein the riser body comprises a riser cavity for receiving liquid metal, wherein the riser body is configured to have multiple parts and comprises at least a first riser body part and a second riser body part, wherein the first and second riser body parts are connectable to each other, wherein the riser cavity is provided in the interior of the at least first and second riser body parts;

wherein the riser body comprises an opening allowing liquid metal to flow into the riser cavity or out of the riser cavity respectively, and wherein the riser body is made of metal.

2. The riser according to claim 1, wherein the riser comprises a connecting element that is suitable to for directly or indirectly connecting the riser body to a casting piece or a mold plate, respectively.

3. The riser according to claim 2, wherein the connecting element is a tube-like body and is preferably made of a metal or a plastic material, wherein the connecting element has a thickness of 0.1 mm to 10 mm, and wherein, independently thereof, the connecting element has a length of 15 mm to 300 mm.

4. The riser according to claim 2, wherein the connecting element is designed to be retractable and is arranged to be movably supported on the riser body, and wherein the connecting element moves in relation to the riser body when compressing the molding material, in that the connecting element is at least partially retractable into the riser body (2).

5. The riser according to claim 2, wherein the connecting element comprises at least one stop and/or one thickening that is configured to prevent the connecting element from slipping into or out of the riser body.

6. The riser according to claim 1, wherein the riser body comprises a sheet metal.

7. The riser according to claim 6, wherein the sheet metal has a thickness of 0.1 mm to 1.2 mm.

8. The riser according to claim 1, wherein the riser body comprises a recess for a centering pin and/or spring pin; or wherein the riser comprises a lid that is arranged in an opening of the riser body, and wherein the lid has an opening for a centering pin or spring pin.

9. The riser according to claim 1, wherein the first and the second riser body part comprises connecting means for connecting the riser body parts to become the riser body.

10. The riser according to claim 1, wherein the riser body is horizontally or vertically divisible into at least two riser body parts.

11. The riser according to claim 1, wherein the first and the second riser body parts are at least substantially equally dimensioned.

12. The riser according to claim 1, wherein the riser body or the second riser body part or both, tapers in the direction of the opening of the riser body.

13. The riser according to claim 12, wherein the riser body or the second riser body part or both, tapers in stair-like steps or in folds such that the riser body or the riser body part can be deformed accordion-like when applying an external pressure.

14. The riser according to claim 1, wherein the riser cavity is formed by joining at least the first and the second riser body parts to result in a substantially horizontally or substantially vertically divisible riser body.

* * * * *